US011111745B2

(12) United States Patent
Scruggs

(10) Patent No.: US 11,111,745 B2
(45) Date of Patent: Sep. 7, 2021

(54) DOWNHOLE ANCHOR WITH STRENGTHENED SLIPS FOR WELL TOOL

(71) Applicant: WEATHERFORD TECHNOLOGY HOLDINGS, LLC, Houston, TX (US)

(72) Inventor: Justin R. Scruggs, Houston, TX (US)

(73) Assignee: Weatherford Technology Holdings, LLC, Houston, TX (US)

( * ) Notice: Subject to any disclaimer, the term of this patent is extended or adjusted under 35 U.S.C. 154(b) by 0 days.

(21) Appl. No.: 16/509,643

(22) Filed: Jul. 12, 2019

(65) Prior Publication Data

US 2021/0010339 A1 Jan. 14, 2021

(51) Int. Cl.
*E21B 23/01* (2006.01)
*E21B 33/129* (2006.01)

(52) U.S. Cl.
CPC ..... *E21B 23/01* (2013.01); *E21B 33/1293* (2013.01)

(58) Field of Classification Search
CPC ..... E21B 23/01; E21B 33/129; E21B 33/1293
See application file for complete search history.

(56) References Cited

U.S. PATENT DOCUMENTS 3,722,588 A * 3/1973 Tamplen ..... E21B 23/06 166/123
4,359,090 A 11/1982 Luke
4,702,313 A * 10/1987 Greenlee ..... E21B 23/01 166/216
2004/0055421 A1 3/2004 Bangert
2005/0224233 A1* 10/2005 Johnson ..... E21B 23/01 166/382
2015/0090441 A1 4/2015 Lovslett et al.

OTHER PUBLICATIONS

Weatherford; "Integraline High-Performance Liner System with Swage Technology", Well Construction article No. 11953.01, dated 2015, 14 pages.
Wikipedia; "Second moment of area", encyclopedia paper via https://en.wikipedia.org/wiki/Second_moment_area, dated Jun. 14, 2019, 7 pages.
Weatherford; "Slip 5,500 Extreme ISO Plug", EPMDocument No. C005794561 B.12, dated May 19, 2016, 1 page.
International Search Report with Written Opinion dated Nov. 11, 2020 for PCT patent application No. PCT/US2020/041715, 19 pages.

* cited by examiner

*Primary Examiner* — Cathleen R Hutchins
(74) *Attorney, Agent, or Firm* — Smith IP Services, P.C.

(57) ABSTRACT

A well tool can include a downhole anchor with at least one outwardly extendable slip including longitudinally spaced apart grip structures, and a longitudinally extending beam which connects the grip structures to each other. The beam has a radial thickness which is greater than a lateral width of the beam. A slip retainer retains the slip, and a spring inwardly biases the slip relative to the slip retainer. The spring surrounds the slip and the slip retainer. An area moment of inertia of the beam with respect to a lateral axis through a centroid of the beam is greater than an area moment of inertia of the beam with respect to a radial axis through the centroid of the beam.

19 Claims, 7 Drawing Sheets

DOWNHOLE ANCHOR WITH STRENGTHENED SLIPS FOR WELL TOOL

BACKGROUND

This disclosure relates generally to equipment utilized and operations performed in conjunction with a subterranean well and, in an example described below, more particularly provides for strengthened slips of the type used in downhole anchors.

A variety of different types of well tools can include a downhole anchor. For example, a packer, bridge plug or liner hanger uses an anchor to prevent displacement relative to a well surface (such as, an interior surface of a casing, liner or wellbore). The anchor can include an element known to those skilled in the art as a "slip," which is designed to grip the well surface.

It will be appreciated that advancements are continually needed in the arts of designing, constructing and utilizing well tools with improved slips. The description below and the accompanying drawings provide such advancements, which may be used with a variety of different types of well tools and in a variety of different well systems.

DETAILED DESCRIPTION

Figure 1:
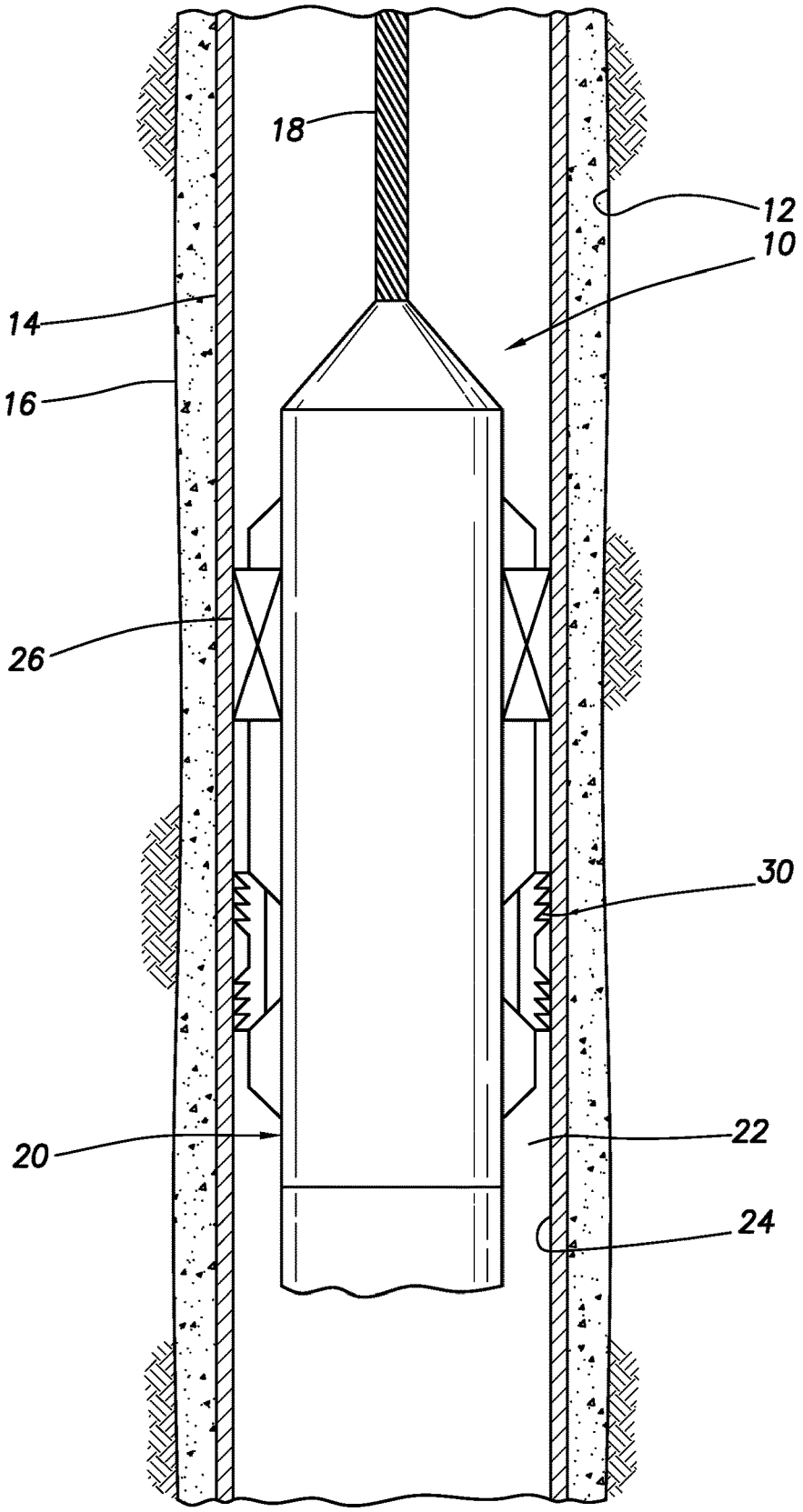
FIG. 1 is a representative partially cross-sectional view of an example of a well system and associated method which can embody principles of this disclosure.

Representatively illustrated in FIG. 1 is a system 10 for use with a subterranean well, and an associated method, which can embody principles of this disclosure. However, it should be clearly understood that the system 10 and method are merely one example of an application of the principles of this disclosure in practice, and a wide variety of other examples are possible. Therefore, the scope of this disclosure is not limited at all to the details of the system 10 and method described herein and/or depicted in the drawings.

In the FIG. 1 example, a wellbore 12 has been drilled into the earth, and the wellbore has been lined with casing 14 and cement 16. In other examples, a section of the wellbore 12 in which the principles of this disclosure are practiced could be uncased or open hole. In addition, although the wellbore 12 is depicted in FIG. 1 as being generally vertical, in other examples the wellbore may be generally horizontal or otherwise inclined from vertical.

A well tool 20 is conveyed into the wellbore 12 using a conveyance 18 (such as, a wireline, electric line, coiled tubing, production tubing, downhole tractor or robot, etc.).

The well tool 20 could be a packer, a bridge plug, a liner hanger, or another type of well tool. In some examples, a conveyance may not be needed to position the well tool 20 at a desired location in the wellbore 12 (e.g., the well tool could be pumped to the desired location).

It is desired in the FIG. 1 example to seal off an annulus 22 formed radially between the well tool 20 and an interior well surface 24. As depicted in FIG. 1, the well surface 24 corresponds to an interior surface of the casing 14. However, if the wellbore 12 is uncased, then the well surface 24 could correspond to an inner wall surface of the wellbore.

For sealing against the well surface 24, the well tool 20 includes an annular seal 26. The annular seal 26 is radially outwardly extendable into sealing engagement with the well surface 24 (such as, in response to activation of an actuator (not shown) of the well tool 20).

The well tool 20 also includes an anchor 30 for grippingly engaging the well surface 24. When the anchor 30 grips the well surface 24, relative longitudinal displacement between the well tool 20 and the well surface is prevented, thereby securing the well tool in the wellbore 12. In some examples, the anchor 30 may be actuated by the same actuator as is used to outwardly extend the annular seal 26.

Note that it is not necessary for the well tool 20 to include the annular seal 26, or for the same actuator to be used to outwardly extend the annular seal and the anchor 30 into engagement with the well surface 24. Thus, the scope of this disclosure is not limited to any particular details of the well tool 20, annular seal 26 and anchor 30 as depicted in FIG. 1 or described herein.

Figure 2:
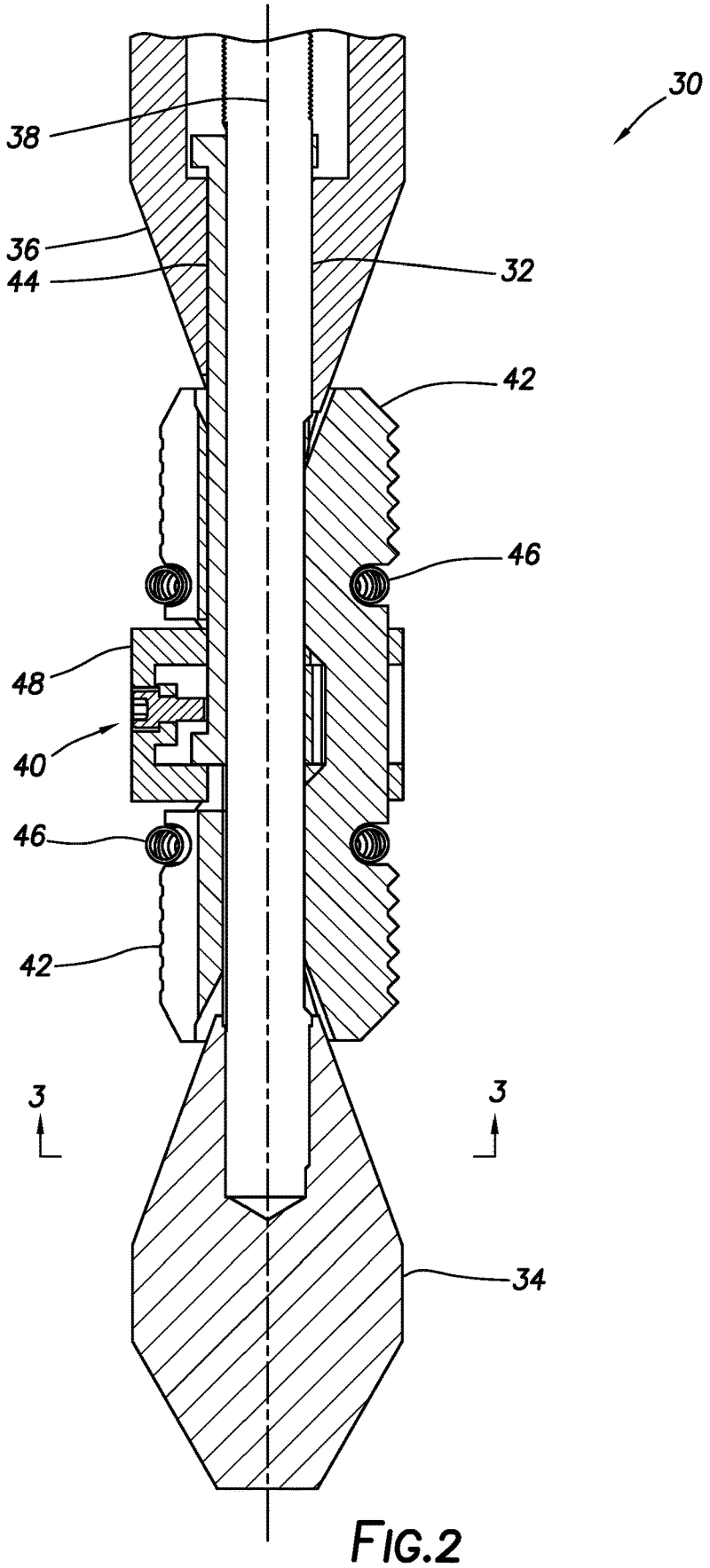
FIG. 2 is a representative cross-sectional view of an example of an anchor section of a well tool that may be used in the system and method of FIG. 1, and which can embody the principles of this disclosure.

Referring additionally now to FIG. 2, a more detailed view of an example of the anchor 30 is representatively illustrated. For clarity and convenience, the anchor 30 is described below as it may be used in the well tool 20, system 10 and method of FIG. 1, but the anchor 30 may be used with other well tools, systems and methods in keeping with the principles of this disclosure.

As depicted in FIG. 2, an inner mandrel 32 extends longitudinally in the anchor 30, and is connected to a lower frusto-conical wedge 34. The inner mandrel 32 extends through an upper frusto-conical wedge 36.

In this example, the actuator of the well tool 20 displaces the upper wedge 36 downward (e.g., along a longitudinal axis 38 of the well tool) relative to the inner mandrel 32 when the well tool is set in the wellbore 12. In this manner, a longitudinal distance between the wedges 34, 36 is decreased when the well tool 20 is set.

A slip assembly 40 is carried on the inner mandrel 32. The slip assembly 40 is positioned longitudinally between the wedges 34, 36, so that, when the longitudinal distance between the wedges is decreased, slips 42 of the slip assembly 40 are displaced radially outward into gripping engagement with the well surface 24.

Figure 5:
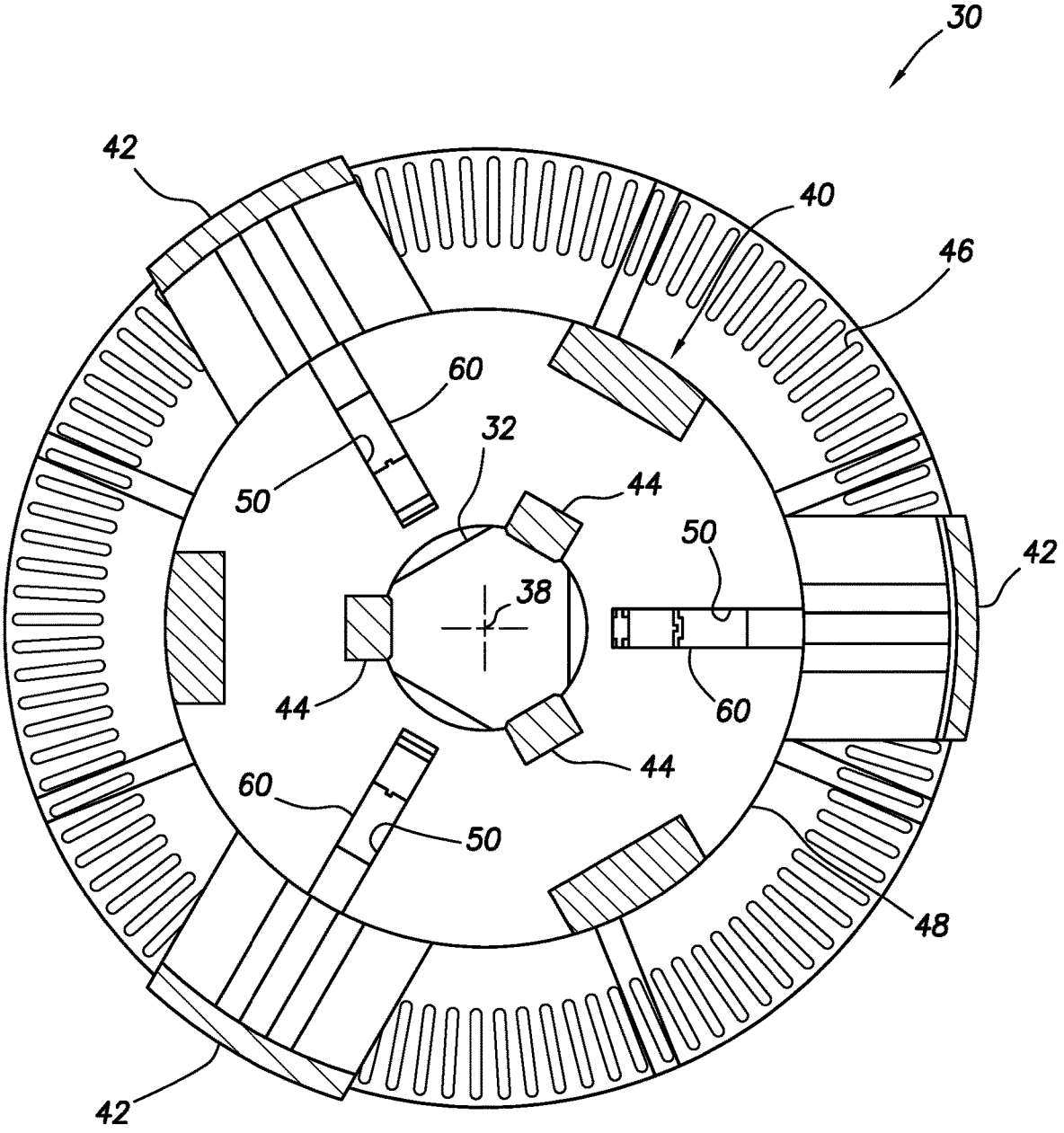
FIG. 5 is a representative cross-sectional view of the anchor section, taken along line 5-5 of FIG. 4.

In the FIG. 2 example, the slip assembly 40 is slidably retained relative to the upper wedge 36 using multiple retainers 44 (only one of which is visible in FIG. 2, see FIG. 5). The retainers 44 limit a longitudinal distance between the upper wedge 36 and the slip assembly 40, but permit the longitudinal distance to decrease when the well tool 20 is set, so that the upper wedge 36 can engage the slips 42 to displace the slips radially outward.

The slip assembly 40 includes springs 46. The springs 46 bias the slips 42 radially inward, so that the slips are maintained in a radially retracted position when the well tool 20 is unset (as depicted in FIG. 2). In this example, the springs 46 are in the form of garter springs (circumferentially continuous coiled extension springs), which outwardly surround and encircle the slips 42.

The slip assembly 40 also includes a slip retainer 48. The slip retainer 48 guides the radial displacement of the slips 42 and positions the slips, so that they are circumferentially distributed about the inner mandrel 32. The slip retainer 48 also engages the retainers 44, in order to limit longitudinal displacement of the slip assembly 40 relative to the upper wedge 36.

Figure 3:
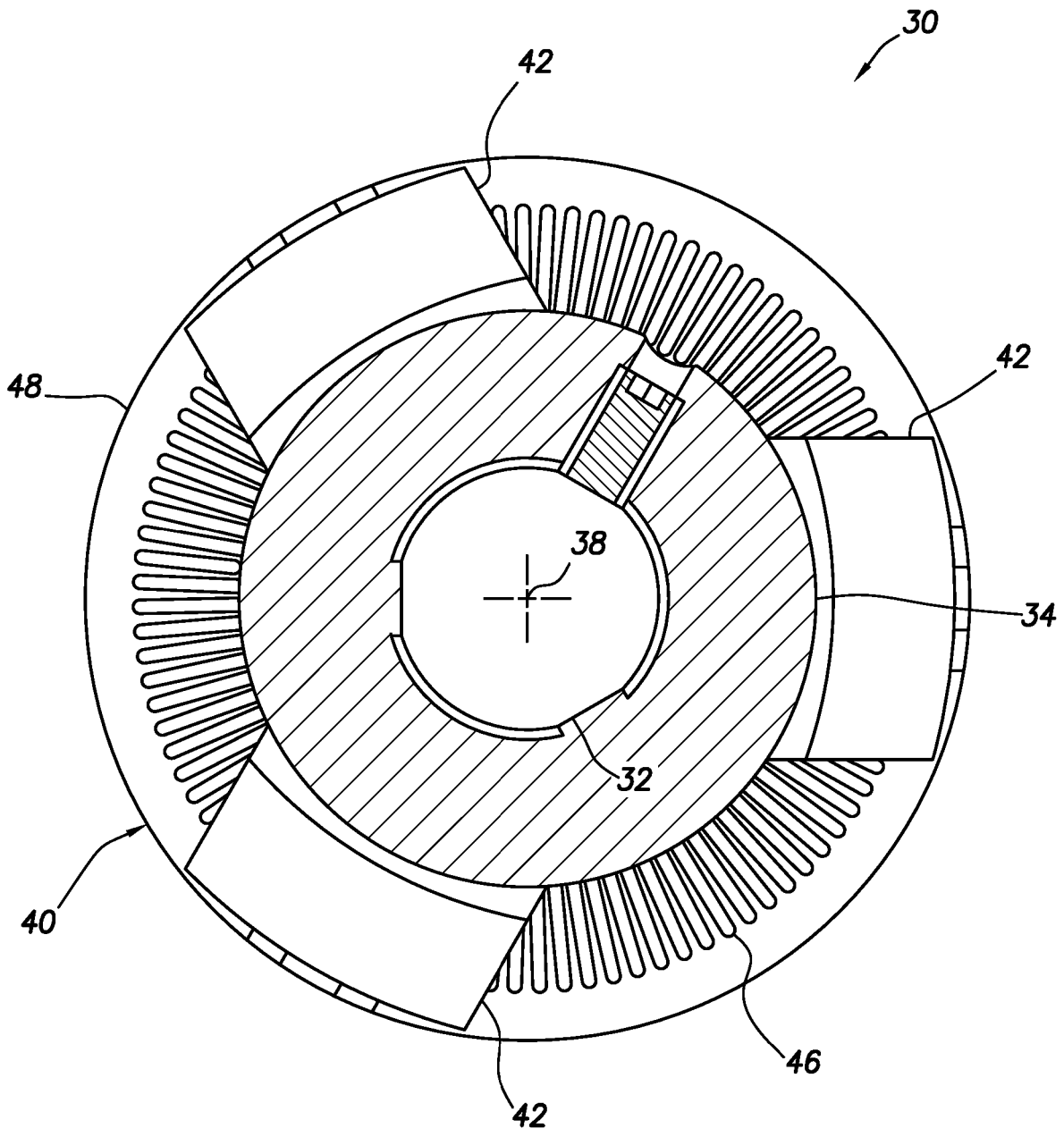
FIG. 3 is a representative cross-sectional view of the anchor section, taken along line 3-3 of FIG. 2.

Referring additionally now to FIG. 3, a cross-sectional view of the anchor 30, taken along line 3-3 of FIG. 2, is representatively illustrated. In this view, the manner in which the slips 42 are circumferentially distributed about the inner mandrel 32 may be seen. In this example, three of the slips 42 are equally distributed at 120 degree intervals about the inner mandrel 32, but in other examples other numbers of slips may be used and the slips may be distributed or configured differently.

Figure 4:
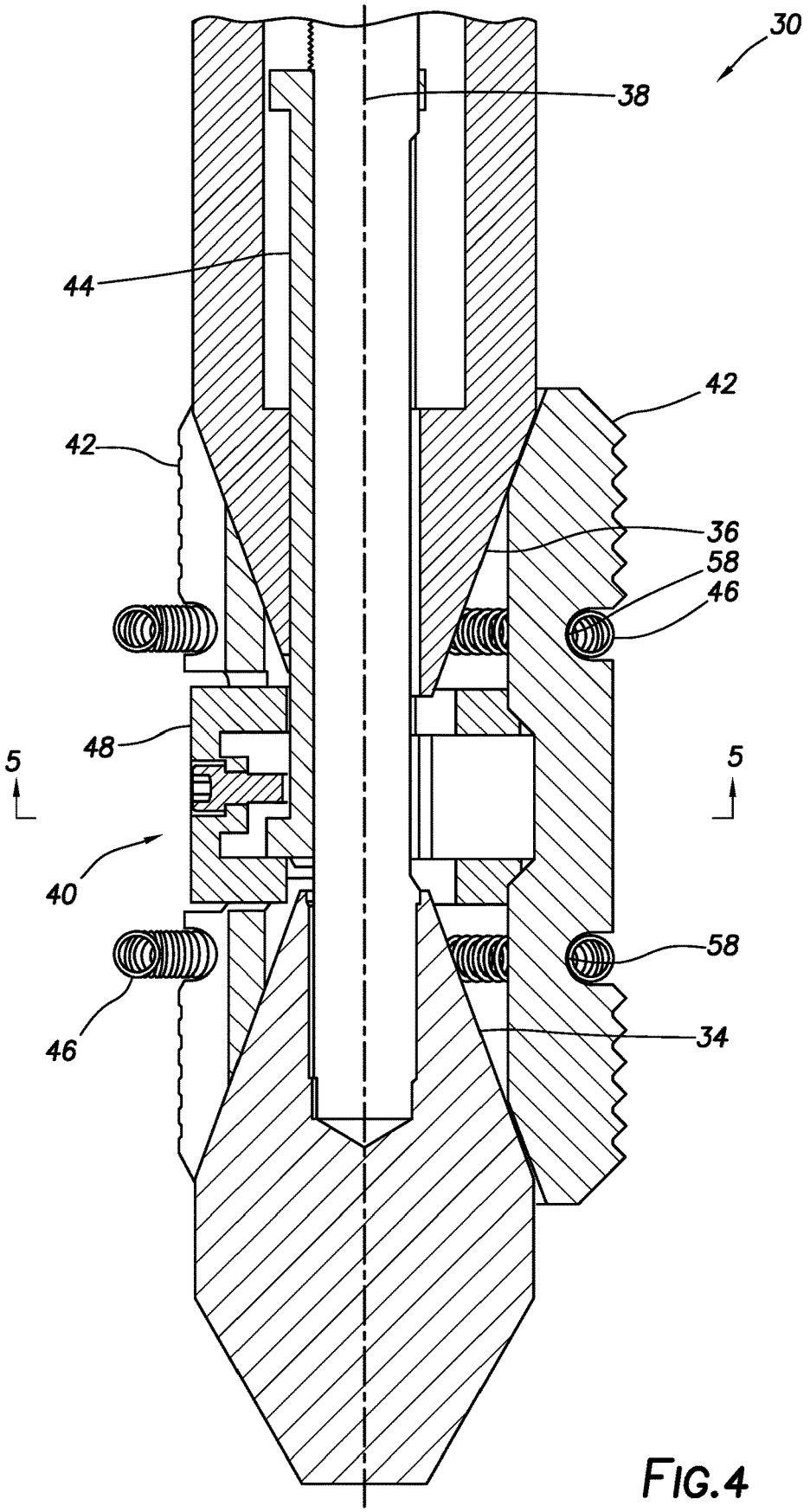
FIG. 4 is a representative cross-sectional view of the anchor section in a set configuration.

Referring additionally now to FIG. 4, a cross-sectional view of the anchor 30 is representatively illustrated. In this view, the anchor 30 is in a set configuration in which the slips 42 are radially outwardly extended into gripping engagement with the well surface 24.

Note that the longitudinal distance between the wedges 34, 36 is decreased, as compared to the unset configuration of FIG. 2. The springs 46 continue to radially inwardly bias the slips 42 so that, if the anchor 30 is subsequently unset, the slips will radially retract out of engagement with the well surface 24.

Referring additionally now to FIG. 5, a cross-sectional view of the anchor 30 is representatively illustrated, taken along line 5-5 of FIG. 4. In this view, it may be seen that the slip retainer 48 has a series of circumferentially distributed and radially extending slots 50 formed therein.

Each of the slips 42 is slidably received in a respective one of the slots 50. In this manner, the circumferential separation of the slips 42 is maintained, while permitting the slips to displace radially outward and inward.

Figure 6:
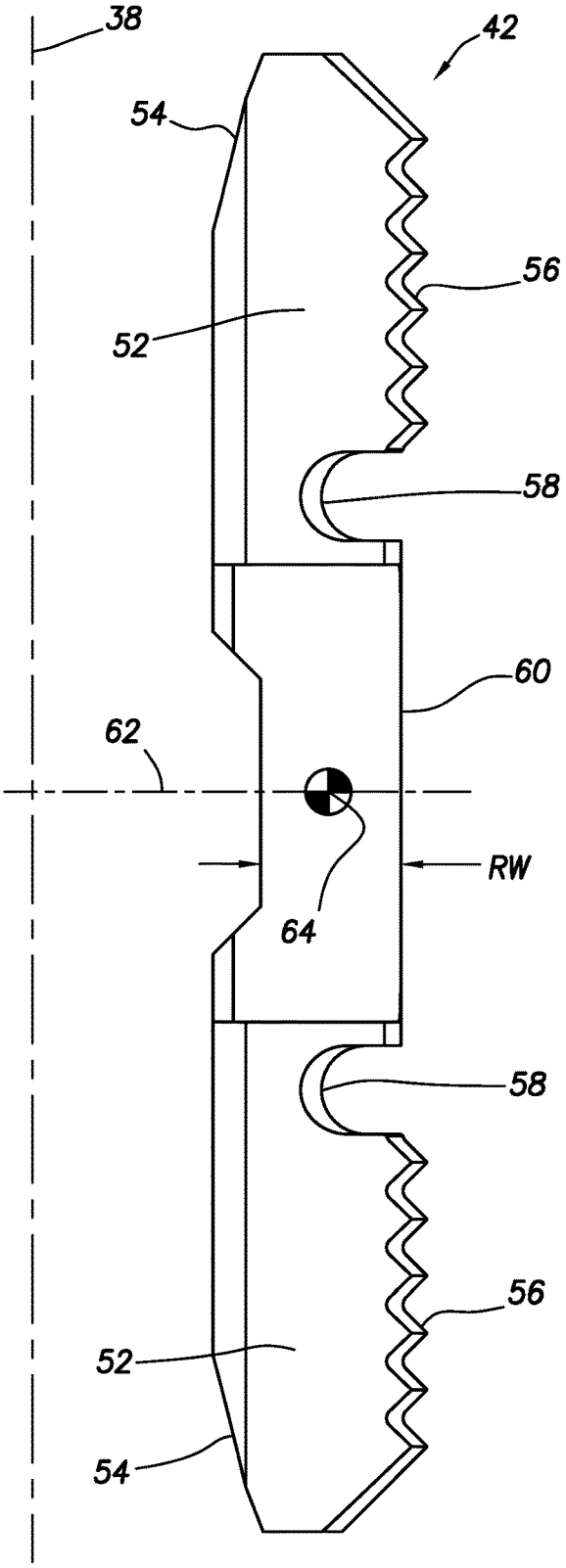
FIG. 6 is a representative side view of an example of a slip of the anchor section.
Figure 7:
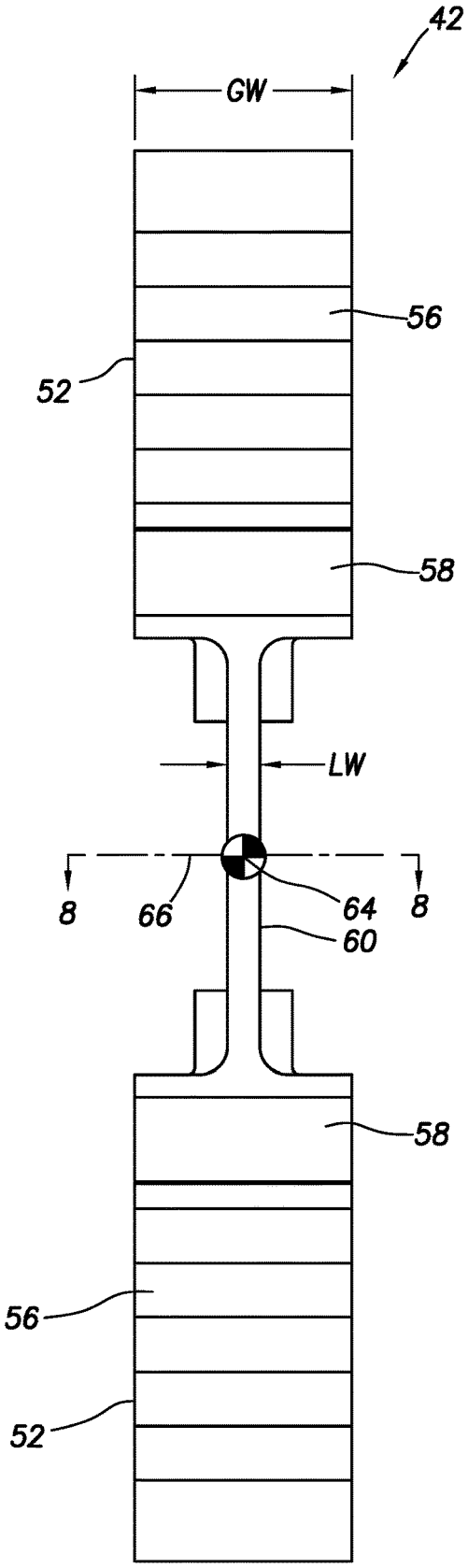
FIG. 7 is a representative front view of the slip.

Referring additionally now to FIGS. 6 & 7, side and front elevational views of an example of the slip 42 are representatively illustrated. The slip 42 depicted in FIGS. 6 & 7 may be used in the well tool 20 and anchor 30 described above, or it may be used with other well tools and anchors.

In the FIGS. 6 & 7 example, the slip 42 includes longitudinally spaced apart grip structures 52. Each of the grip structures 52 is configured to grippingly engage a well surface. In addition, the grip structures 52 include inclined surfaces 54 formed thereon for cooperative engagement with the wedges 34, 36.

For enhanced gripping of the well surface, the grip structures 52 have external grip surfaces 56 disposed thereon. In this example, the grip surfaces 56 are in the form of longitudinally spaced apart ridges or teeth formed on the grip structures 52, but in other examples the grip surfaces 56 could comprise embedded substances (such as carbide) or other components that enhance the gripping engagement between the slip 42 and the well surface. As depicted in FIG. 7, a lateral width GW of the grip surfaces 56 is greater than a lateral width LW of the beam 60.

Laterally extending spring retainer recesses 58 are formed in the slip 42. In the slip assembly 40, the springs 46 are received in the spring retainer recesses 58 (see FIG. 4). In this example, each of the recesses 58 is positioned longitudinally between one of the grip structures 52 and a beam 60 that connects the grip structures to each other.

The beam 60 is configured for sliding engagement in one of the slots 50 in the slip retainer 48 (see FIG. 5). The beam 60 is radially displaceable in a slot 50 relative to the slip retainer 48.

The beam 60 is also configured to resist bending moments experienced as a result of forces applied due to the gripping engagement between the grip structures 52 and the well surface, and due to engagement between the grip structures and the wedges 34, 36. In this example, a radial width RW of the beam 60 along a radial axis 62 intersecting a centroid 64 of the beam is greater than the lateral width LW of the beam along a lateral axis 66 intersecting the centroid.

Figure 8:
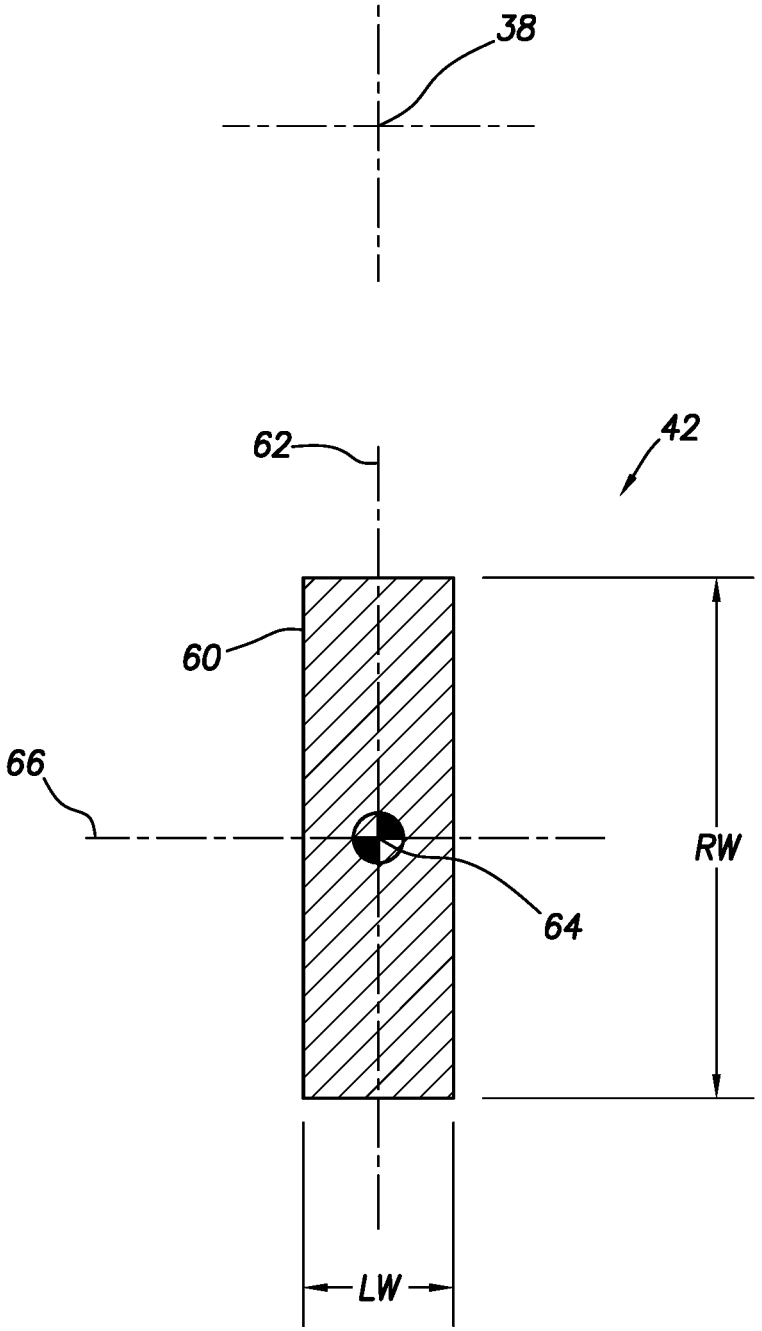
FIG. 8 is a representative cross-sectional view of the slip, taken along line 8-8 of FIG. 7.

Referring additionally now to FIG. 8, a cross-sectional view of the beam 60, taken along line 8-8 of FIG. 7 is representatively illustrated. In this view, relative orientations between the axes 38, 62, 66, the centroid 64, the beam radial width RW and the beam lateral width LW may be clearly seen. Note that the axes 38, 62, 66 are orthogonal to each other, and each of the axes 62, 66 passes through the centroid 64 of the beam 60.

As a result of the unique configuration of the beam 60, a second moment of area (also known as an area moment of inertia or a second area moment) of the beam about the lateral axis 66 is greater than a second moment of area of the beam about the radial axis 62. Thus, a bending strength of the beam 60 about the lateral axis 66 is greater than a bending strength of the beam about the radial axis 62.

In the FIGS. 2-5 example described above, the retainers 44 prevent the slips 42 from being inadvertently set while the well tool 20 is being conveyed into the well in the unset position. The retainers 44 rest in longitudinal tracks that are machined into an outer surface of the mandrel 32 (see FIG. 5). Because lower ends of the retainers 44 are secured in the slip retainer 48, the retainers are fixed to the slip assembly 40 on that end.

Furthermore, because the retainers 44 are resting in the longitudinal tracks on the mandrel 32, and because these tracks do not run the full length of the mandrel, when the tool 20 is in an unset configuration (see FIG. 2), the retainers are, unable to displace significantly in either longitudinal direction. As a result, when the tool 20 is in the unset configuration and being conveyed into the well, it is not possible for the slips 42 to be inadvertently set in the event that they pass through a restriction or other obstruction in the well.

In the set configuration (see FIG. 4), once the lower wedge 34 has moved up relative to the upper wedge 34, the entire slip assembly 40 moves up with the lower wedge 34. Since the retainers 44 are constrained to the slip retainer 48, as the slip assembly 40 displaces upward, so too do the retainers.

As a result, when it comes time to retract the slips 42 and retrieve the tool 20, when the upper wedge 36 is pulled up and away from the lower wedge 34, an internal shoulder in the upper wedge 36 contacts upper shoulders of the retainers 44, thus pulling them upwards as well. Because the retainers 44 are constrained to the slip assembly 40, when the upper wedge 36 is pulled up and away from the lower wedge 34, it also pulls the slip assembly 40 off of the lower wedge 34, thus fully retracting the slips 42.

It may now be fully appreciated that the above disclosure provides significant advances to the arts of designing, constructing and utilizing well tools with improved slips. In examples described above, the slip 42 can more effectively resist bending moments applied to the slip about a lateral axis 66 of the beam 60. In addition, the spring 46 is received in recesses 58 on an exterior of the slip 42, and does not interfere with or limit the extension or retraction of the slip.

The above disclosure provides to the art a well tool 20 comprising a downhole anchor 30 including at least one outwardly extendable slip 42 configured to grip a well surface 24. The slip 42 in this example comprises longitudinally spaced apart grip structures 52, and a longitudinally extending beam 60 which connects the grip structures 52 to each other. The beam 60 has a radial thickness RW which is greater than a lateral width LW of the beam 60.

In any of the well tool examples described herein:

Each of the grip structures 52 may comprise a grip surface 56. A lateral width GW of the grip surfaces 56 may be greater than the lateral width LW of the beam 60.

A spring retainer recess 58 may be formed in the slip 42 longitudinally between the beam 60 and at least one of the grip structures 52. A spring 46 may be received in the spring retainer recess 58. The spring 46 may surround the slip 42. A garter spring 46 may be received in the spring retainer recess 58.

The beam 60 may be received in a radially extending slot 50 formed in a slip retainer 48. A spring 46 may bias the slip 42 radially inward relative to the slip retainer 48, with the spring 46 surrounding the slip 42 and the slip retainer 48.

An area moment of inertia of the beam 60 with respect to a lateral axis 66 through a centroid 64 of the beam 60 may be greater than an area moment of inertia of the beam 60 with respect to a radial axis 62 through the centroid 64 of the beam 60. Each of the lateral axis 66 and the radial axis 62 is perpendicular to a central longitudinal axis 38 of the well tool 20.

The well tool 20 can include at least one retainer 44 having first and second opposite ends, the first opposite end being secured to the slip retainer 48, the second opposite end being reciprocably received in a wedge 36 that outwardly deflects the slip 42. Relative longitudinal displacement between the retainer 44 and the wedge 36 may be limited.

The above disclosure also provides to the art a well tool 20 comprising a downhole anchor 30 including at least one outwardly extendable slip 42 configured to grip a well surface 24, a slip retainer 48 that retains the slip 42, and a spring 46 that inwardly biases the slip 42 relative to the slip retainer 48. The spring 46 surrounds the slip 42 and the slip retainer 48.

Another well tool 20 is provided to the art by the above disclosure. In this example, the well tool 20 comprises a central longitudinal axis 38 and a downhole anchor 30 including at least one outwardly extendable slip 42 configured to grip a well surface 24. The slip 42 comprises longitudinally spaced apart grip structures 52 and a longitudinally extending beam 60 which connects the grip structures 52 to each other. An area moment of inertia of the beam 60 with respect to a lateral axis 66 through a centroid 64 of the beam 60 is greater than an area moment of inertia of the beam 60 with respect to a radial axis 62 through the centroid 64 of the beam 60. Each of the lateral axis 66 and the radial axis 62 is perpendicular to the central longitudinal axis 38.

Although various examples have been described above, with each example having certain features, it should be understood that it is not necessary for a particular feature of one example to be used exclusively with that example. Instead, any of the features described above and/or depicted in the drawings can be combined with any of the examples, in addition to or in substitution for any of the other features of those examples. One example's features are not mutually exclusive to another example's features. Instead, the scope of this disclosure encompasses any combination of any of the features.

Although each example described above includes a certain combination of features, it should be understood that it is not necessary for all features of an example to be used. Instead, any of the features described above can be used, without any other particular feature or features also being used.

It should be understood that the various embodiments described herein may be utilized in various orientations, such as inclined, inverted, horizontal, vertical, etc., and in various configurations, without departing from the principles of this disclosure. The embodiments are described merely as examples of useful applications of the principles of the disclosure, which is not limited to any specific details of these embodiments.

In the above description of the representative examples, directional terms (such as "above," "below," "upper," "lower," "upward," "downward," etc.) are used for convenience in referring to the accompanying drawings. However, it should be clearly understood that the scope of this disclosure is not limited to any particular directions described herein.

The terms "including," "includes," "comprising," "comprises," and similar terms are used in a non-limiting sense in this specification. For example, if a system, method, apparatus, device, etc., is described as "including" a certain feature or element, the system, method, apparatus, device, etc., can include that feature or element, and can also include other features or elements. Similarly, the term "comprises" is considered to mean "comprises, but is not limited to."

Of course, a person skilled in the art would, upon a careful consideration of the above description of representative embodiments of the disclosure, readily appreciate that many modifications, additions, substitutions, deletions, and other changes may be made to the specific embodiments, and such changes are contemplated by the principles of this disclosure. For example, structures disclosed as being separately formed can, in other examples, be integrally formed and vice versa. Accordingly, the foregoing detailed description is to be clearly understood as being given by way of illustration and example only, the spirit and scope of the invention being limited solely by the appended claims and their equivalents.

What is claimed is:

1. A well tool, comprising:

a downhole anchor including at least one outwardly extendable slip configured to grip a well surface, the slip comprising longitudinally spaced apart grip structures, and a longitudinally extending beam which connects the grip structures to each other, and the beam having a radial thickness which is greater than a lateral width of the beam.

2. The well tool of claim 1, in which each of the grip structures comprises a grip surface, and a lateral width of the grip surfaces is greater than the lateral width of the beam.

3. The well tool of claim 1, in which a spring retainer recess is formed in the slip longitudinally between the beam and at least one of the grip structures.

4. The well tool of claim 3, in which a spring is received in the spring retainer recess, and the spring surrounds the slip.

5. The well tool of claim 3, in which a garter spring is received in the spring retainer recess.

6. The well tool of claim 1, in which the beam is received in a radially extending slot formed in a slip retainer, a spring biases the slip radially inward relative to the slip retainer, and the spring surrounds the slip and the slip retainer.

7. The well tool of claim 1, in which a first area moment of inertia of the beam with respect to a lateral axis through a centroid of the beam is greater than a second area moment of inertia of the beam with respect to a radial axis through the centroid of the beam, each of the lateral axis and the radial axis being perpendicular to a central longitudinal axis of the well tool.

8. A well tool, comprising:

a downhole anchor including at least one outwardly extendable slip configured to grip a well surface, a slip retainer that circumferentially positions the slip in the anchor, and a spring that inwardly biases the slip relative to the slip retainer, in which the slip comprises longitudinally spaced apart grip structures, and a longitudinally extending beam which connects the grip structures to each other, in which the beam has a radial thickness which is greater than a lateral width of the beam, in which the spring surrounds the slip and the slip retainer.

9. The well tool of claim 8, in which the spring comprises a garter spring.

10. The well tool of claim 8, in which a first area moment of inertia of the beam with respect to a lateral axis through a centroid of the beam is greater than a second area moment of inertia of the beam with respect to a radial axis through the centroid of the beam, each of the lateral axis and the radial axis being perpendicular to a central longitudinal axis of the well tool.

11. The well tool of claim 8, in which the beam is received in a radially extending slot formed in the slip retainer.

12. The well tool of claim 8, in which a spring retainer recess is formed in the slip longitudinally between the beam and at least one of the grip structures.

13. A well tool, comprising:

a central longitudinal axis; and a downhole anchor including at least one outwardly extendable slip configured to grip a well surface, the slip comprising longitudinally spaced apart grip structures, and a longitudinally extending beam which connects the grip structures to each other, and in which an area moment of inertia of the beam with respect to a lateral axis through a centroid of the beam is greater than an area moment of inertia of the beam with respect to a radial axis through the centroid of the beam, each of the lateral axis and the radial axis being perpendicular to the central longitudinal axis.

14. The well tool of claim 13, in which each of the grip structures comprises a grip surface, and a lateral width of the grip surfaces is greater than the lateral width of the beam.

15. The well tool of claim 13, in which a spring retainer recess is formed in the slip longitudinally between the beam and at least one of the grip structures.

16. The well tool of claim 15, in which a spring is received in the spring retainer recess, and the spring surrounds the slip.

17. The well tool of claim 13, in which the beam is received in a radially extending slot formed in a slip retainer, a spring biases the slip radially inward relative to the slip retainer, and the spring surrounds the slip and the slip retainer.

18. The well tool of claim 17, further comprising at least one longitudinal retainer having first and second opposite ends, the first opposite end being secured to the slip retainer, the second opposite end being reciprocably received in a wedge that outwardly deflects the slip, and relative longitudinal displacement between the longitudinal retainer and the wedge being limited.

19. The well tool of claim 13, in which the beam has a minimum radial thickness which is greater than a minimum lateral width of the beam.

* * * * *